US010350659B2

(12) United States Patent
Hayashi et al.

(10) Patent No.: US 10,350,659 B2
(45) Date of Patent: Jul. 16, 2019

(54) COOLING METHOD AND COOLING APPARATUS FOR HOT-ROLLED STEEL SHEET

(71) Applicant: NIPPON STEEL & SUMITOMO METAL CORPORATION, Tokyo (JP)

(72) Inventors: Satoru Hayashi, Tokyo (JP); Yoshihiro Serizawa, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 0 days.

(21) Appl. No.: 15/774,917

(22) PCT Filed: Oct. 27, 2016

(86) PCT No.: PCT/JP2016/081947
§ 371 (c)(1),
(2) Date: May 9, 2018

(87) PCT Pub. No.: WO2018/073973
PCT Pub. Date: Apr. 26, 2018

(65) Prior Publication Data

US 2018/0290193 A1 Oct. 11, 2018

(30) Foreign Application Priority Data

Oct. 19, 2016 (JP) ..... 2016-205132

(51) Int. Cl.
*B21B 45/02* (2006.01)
*C21D 8/02* (2006.01)

(52) U.S. Cl.
CPC ..... *B21B 45/0218* (2013.01); *B21B 45/02* (2013.01); *B21B 45/0233* (2013.01);
(Continued)

(58) Field of Classification Search
CPC . B21B 45/02; B21B 45/0218; B21B 45/0233; B21B 45/0281; C21D 8/02; C21D 8/0205
(Continued)

(56) References Cited

U.S. PATENT DOCUMENTS

2017/0189949 A1 7/2017 Duhoux et al.

FOREIGN PATENT DOCUMENTS

CN 2579542 Y 10/2003
CN 203292196 U 11/2013
(Continued)

OTHER PUBLICATIONS

International Search Report for PCT/JP2016/081947 dated Jan. 17, 2017.
(Continued)

*Primary Examiner* — Brian D Walck
(74) *Attorney, Agent, or Firm* — Birch, Stewart, Kolasch & Birch, LLP

(57) ABSTRACT

A hot-rolled steel sheet is cooled by jetting cooling water from spray nozzles to a steel sheet conveyance region in a width direction of the steel sheet conveyance region. The steel sheet conveyance region is a region that the hot-rolled steel sheet occupies on conveyor rolls, a pair of spray nozzles is arranged on both lateral sides in the width direction of the steel sheet conveyance region, and a plurality of spray nozzle pairs are aligned in a conveyance direction of the hot-rolled steel sheet. In regard to a collision region of cooling water jetted from the spray nozzle at the steel sheet conveyance region, a far end in a jet direction is positioned at an end of the steel sheet conveyance region, and a near end is positioned on an inner side of the steel sheet conveyance region. In the spray nozzle pair, the near ends of two collision regions coincide in the width direction to form a meeting.

5 Claims, 10 Drawing Sheets

(52) U.S. Cl.
CPC ..... *B21B 45/0281* (2013.01); *C21D 8/02* (2013.01); *C21D 8/0205* (2013.01)

(58) Field of Classification Search
USPC ..... 148/637
See application file for complete search history.

(56) References Cited

FOREIGN PATENT DOCUMENTS

| | | | |
|---|---|---|---|
| EP | 1 935 522 | A1 | 6/2008 |
| JP | 57-106752 | U | 7/1982 |
| JP | 59-13573 | B2 | 3/1984 |
| JP | 2008-110353 | A | 5/2008 |
| JP | 2011-51002 | A | 3/2011 |
| JP | 2014-124634 | A | 7/2014 |
| JP | 2015-73995 | A | 4/2015 |
| JP | 2016-193446 | A | 11/2016 |
| TW | 201622843 | A | 7/2016 |
| WO | WO 2011/115277 | A1 | 9/2011 |
| WO | WO 2016/006402 | A1 | 1/2016 |

OTHER PUBLICATIONS

Office Action for JP 2017-506422 dated Apr. 11, 2017.
Office Action for TW 105134952 dated Sep. 14, 2017.
Written Opinion of the International Searching Authority for PCT/JP2016/081947(PCT/ISA/237) dated Jan. 17, 2017.

COOLING METHOD AND COOLING APPARATUS FOR HOT-ROLLED STEEL SHEET

TECHNICAL FIELD

The present invention relates to a method and an apparatus for cooling a hot-rolled steel sheet after finish rolling of a continuous hot rolling process.

BACKGROUND ART

A hot-rolled steel sheet after finish rolling of a continuous hot rolling process is, on a run-out table installed between the finish rolling mill and a winding apparatus, cooled to a predetermined temperature by a cooling apparatus provided above and below the run-out table, for example, and is then wound around the winding apparatus. In the hot rolling of the hot-rolled steel sheet, the cooling performance after finish rolling is an important factor in determining the mechanical properties, formability, weldability, etc. of the hot-rolled steel sheet, and it is important to uniformly cool the hot-rolled steel sheet to a predetermined temperature.

Hence, various methods and apparatuses have been conventionally proposed for this cooling of a hot-rolled steel sheet.

Patent Literature 1 proposes a method for cooling a hot strip, which is obtained after a hot rolling process, by bringing cooling water into contact with the hot strip, including: a first cooling step and a subsequent second cooling step, in which cooling is stopped at a strip temperature that is higher than a transition boiling start temperature in the first cooling step, and the cooling is conducted using the cooling water having a water flow density that causes nuclear boiling in the subsequent second cooling step. In addition, in the second cooling step, at least the upper surface of the strip is cooled by laminar cooling or jet cooling. Furthermore, in the second cooling step, the cooling water supplied to the upper surface of the strip is drained using water removing means, such as jet nozzles that eject a high-pressure fluid to the upper surface of the strip and a roll placed on the upper surface of the strip in its width direction.

Patent Literature 2 proposes a thick steel plate producing apparatus equipped with a conveyor line including a table roller that conveys a rolled thick steel plate from a roller to a hot leveler. Water spraying apparatuses that spray water on both surfaces of the steel plate are provided along the conveyor line at positions thereabove and therebelow. A roller exit-side water spray apparatus in which multiple cooling nozzles for spraying water are arranged along both outer sides of the conveyor line, upstream of the hot leveler of the conveyor line.

Patent Literature 3 proposes a cooling apparatus that jets cooling water to an upper surface of a hot-rolled steel sheet. On two positions in a longitudinal direction of the hot-rolled steel sheet, two cooling headers sandwiching the hot-rolled steel sheet in a width direction of the hot-rolled steel sheet are installed, namely four cooling headers are installed in total. From cooling nozzles attached to the respective cooling headers, cooling water is jetted toward the center of the four positions.

Patent Literature 4 proposes a cooling apparatus that cools hot-rolled steel material delivered from a finish rolling mill by supplying a coolant from a plurality of cooling banks. Nozzles for water removal are provided between the plurality of cooling banks, the nozzles for water removal being provided in both lateral sides in the width direction of the hot-rolled steel material, and high-pressure water is jetted to cross the width direction of the hot-rolled steel material.

Patent Literature 5 proposes a cooling apparatus that cools hot-rolled material travelling on a hot run table with cooling water in a curtain form falling from a slit nozzle of a cooling water header. Sprays are provided on both lateral sides of the hot run table, and pressure water jetted from each spray is directed so as to cross from the center part in the width direction of the hot-rolled material to an outer end. This pressure water from the sprays removes mutual interacting flow of cooling water occurring on the hot-rolled material.

Patent Literature 6 proposes a water removing method that removes cooling water jetted to a hot-rolled steel sheet when cooling the hot-rolled steel sheet before and after finish rolling, the water removing method including: removing cooling water by jetting water-removing water in a width direction of the hot-rolled steel sheet with a plurality of water removing nozzles that are aligned in a conveyance direction of the hot-rolled steel sheet on one lateral side or both lateral sides in a width direction of the hot-rolled steel sheet.

CITATION LIST

Patent Literature

| | |
|---|---|
| Patent Literature 1: | JP 2008-110353A |
| Patent Literature 2: | WO 2011/115277 |
| Patent Literature 3: | JP 2015-073995A |
| Patent Literature 4: | JP S59-013573B |
| Patent Literature 5: | Japanese Unexamined Utility Model Application Publication No. S57-106752 |
| Patent Literature 6: | WO 2016/006402 |

SUMMARY OF INVENTION

Technical Problem

In the cooling method disclosed in Patent Literature 1, at least the upper surface of the strip is cooled by laminar cooling or jet cooling in the second cooling step, and the hot strip is cooled in nuclear boiling; however, the laminar cooling or jet cooling cannot remove cooling water. Moreover, in the case where water removal is performed using high-pressure fluids in a rod form from the jet nozzles, for example, water leaks from a gap between the high-pressure fluids, and water removal cannot be performed completely with the high-pressure fluids; thus, cooling due to on-sheet water on the strip occurs. This results in ununiform cooling of the hot strip. Moreover, in the case where water removal is performed using a roll, for example, initial biting when the tip of the strip is sprung is difficult, and a facility for causing the roll to retreat initially, for example, is needed, which is economically disadvantageous. In addition, at a line speed (e.g., approximately 15 m/sec) assumed in hot rolling, the hot strip may be damaged by intermittent contact with the roll due to a flutter of the hot strip, or vibration, during passing of the strip.

In this point, the apparatuses and methods disclosed in Patent Literatures 2 to 6 jets cooling water (water-removing water) from a lateral side of the hot-rolled steel sheet in the width direction, instead of jetting cooling water from above the hot-rolled steel sheet.

In the roller exit-side water spray apparatus disclosed in Patent Literature 2, water is sprayed in the width direction of the thick steel plate from the cooling nozzle; a collision region of water sprayed from the cooling nozzle at the thick steel plate covers almost the entire width direction of the thick steel plate. Therefore, two collision regions from a pair of cooling nozzles provided on both outer sides of the conveyor line overlap at both ends of the thick steel plate. Here, in the collision region from the cooling nozzle, a near end on the cooling nozzle side undergoes high pressure because it is near to the cooling nozzle. Then, since two collision regions from a pair of cooling nozzles overlap at both ends of the thick steel plate, the end is subjected to overcooling, causing cooling unevenness in the width direction. Moreover, in the invention disclosed in Patent Literature 2, an object is to cover the steel plate surface with water in order to suppress scale on the steel plate surface; thus, the amount of water is small, and the ability to drain on-sheet water on the steel plate is low. This makes cooling of the thick steel plate ununiform.

In the cooling apparatus disclosed in Patent Literature 3, cooling water is jetted from four cooling nozzles in the width direction of the hot-rolled steel sheet toward the center of the four positions; in this case, near a collision point of cooling water from a pair of cooling nozzles opposing in the width direction, the ability to drain on-sheet water on the hot-rolled steel sheet is low, and on-sheet water builds up also at the center. This on-sheet water makes cooling of the hot-rolled steel sheet ununiform.

In the cooling apparatus disclosed in Patent Literature 4, high-pressure water is jetted by the nozzle for water removal to cross the width direction of the hot-rolled steel material; a collision region of high-pressure water jetted from the nozzle for water removal at the hot-rolled steel material covers almost the entire width direction of the hot-rolled steel material. Therefore, two collision regions from a pair of nozzles for water removal provided on both lateral sides of the hot-rolled steel material overlap also at both ends of the hot-rolled steel sheet. As mentioned above, in the collision region from the nozzle for water removal, a near end on the nozzle-for-water-removal side undergoes high pressure and tends to be subjected to overcooling; thus, both ends of the hot-rolled steel sheet where two collision regions from a pair of nozzles for water removal overlap are subjected to overcooling, causing cooling unevenness in the width direction. Note that Patent Literature 4 does not disclose providing a plurality of pairs of nozzles for water removal.

In the cooling apparatus disclosed in Patent Literature 5, pressure water jetted from the spray is directed so as to cross from the center part in the width direction of the hot-rolled material to an outer end, and a collision region of pressure water jetted from the spray at the hot-rolled material covers at least half or more of the width of the hot-rolled material. Therefore, two collision regions from a pair of sprays provided on both lateral sides of the hot-rolled material overlap at the center of the hot-rolled material. Then, in the case where the spray is used for cooling the hot-rolled material, a center portion of the hot-rolled material where two collision regions from a pair of sprays overlap is subjected to overcooling, causing cooling unevenness in the width direction. Note that Patent Literature 5 does not disclose providing a plurality of pairs of sprays.

In the water removing method disclosed in Patent Literature 6, the water removing nozzle jets water-removing water in the width direction of the hot-rolled steel sheet. Collision regions of water-removing water jetted from a plurality of water removing nozzles cover the entire width direction of the hot-rolled steel sheet, and further, collision regions from the water removing nozzles are provided in a manner that collision regions adjacent to each other in the width direction partly overlap in the width direction. Then, in the case where the water removing nozzle is used for cooling the hot-rolled steel sheet, since collision regions from water removing nozzles overlap, the overlap portion is subjected to overcooling, causing cooling unevenness in the width direction.

As described above, conventional cooling methods and cooling apparatuses for hot-rolled steel sheets have room for improvement.

In view of these points, an object of the present invention is to cool a hot-rolled steel sheet after finish rolling of a continuous hot rolling process appropriately and uniformly.

Solution to Problem

According to the present invention in order to achieve the above-mentioned object, there is provided a method for cooling a hot-rolled steel sheet after finish rolling of a continuous hot rolling process, the cooling method including: cooling the hot-rolled steel sheet by jetting cooling water from spray nozzles to a steel sheet conveyance region in a width direction of the steel sheet conveyance region. The steel sheet conveyance region is a region that the hot-rolled steel sheet occupies on conveyor rolls, a pair of spray nozzles is arranged on both lateral sides in the width direction of the steel sheet conveyance region, and a plurality of spray nozzle pairs are aligned in a conveyance direction of the hot-rolled steel sheet. In regard to a collision region of cooling water jetted from the spray nozzle at the steel sheet conveyance region, a far end in a jet direction is positioned at an end of the steel sheet conveyance region, and a near end is positioned on an inner side of the steel sheet conveyance region. In the spray nozzle pair, the near ends of two collision regions coincide in the width direction to form a meeting. Note that a width of the steel sheet conveyance region is the same as the maximum width of a hot-rolled steel sheet to be cooled by the cooling method of the present invention. Therefore, in the case where a hot-rolled steel sheet having a width narrower than the maximum width is cooled, cooling water that is jetted to a portion not occupied by the hot-rolled steel sheet with the narrow width on the end side in the width direction of the steel sheet conveyance region falls below the pass line of the hot-rolled steel sheet without colliding with the hot-rolled steel sheet.

According to the present invention, since the meeting is formed in the two collision regions of the spray nozzle pair, these collision regions do not overlap in the width direction of the steel sheet conveyance region, and cover the entire width direction. Consequently, cooling unevenness due to overlap of collision regions in the width direction in a conventional case can be suppressed, and the hot-rolled steel sheet can be cooled uniformly in the width direction. In other words, forming a meeting of collision regions as in the present invention is an innovative point not disclosed at all in the conventional literatures mentioned above, and is very useful for uniform cooling of a hot-rolled steel sheet.

The meeting may be positioned within a meeting zone marked off at the center in the width direction of the steel sheet conveyance region, a width of the meeting zone may satisfy Formula (1) below, and an interval in the width direction between the meetings of the spray nozzle pairs adjacent to each other in the conveyance direction may be a length of the collision region in the conveyance direction or more.

$$W \leq (D+2d)-(D+d)\sin\theta_2/\sin(\theta_1+\theta_2) \quad (1)$$

W is the width of the meeting zone, D is a width of the steel sheet conveyance region, d is a horizontal distance between a jet of the spray nozzle and an end of the steel sheet conveyance region on a side near to the jet, $\theta_1$ is a spray jet angle, and $\theta_2$ is a spray installation angle (an angle formed by a perpendicular from the jet of the spray nozzle and a line connecting the jet of the spray nozzle and the center in the width direction of the steel sheet conveyance region).

A cooling zone in which cooling water is jetted from the plurality of spray nozzle pairs toward the steel sheet conveyance region may be divided into a plurality of cooling small zones in the conveyance direction, N spray nozzle pairs (N is an integer) may be arranged in the cooling small zone, the meeting zone may be divided into N meeting small zones at equal intervals in the width direction, one meeting may be placed in each meeting small zone in the cooling small zone, and the meetings in the cooling small zone may be arranged from an upstream side toward a downstream side in the conveyance direction, from the meeting small zone at one end of the meeting zone toward the meeting small zone at the other end.

The cooling small zone may be divided into k divided cooling small zones (k is a submultiple of N) in the conveyance direction, and in the i-th divided cooling small zone (i is an integer of 1 to k) in the conveyance direction, the meetings may be arranged in the i-th to (jk+i)-th meeting small zones (j is an integer of 1 to (N/k−1), from the first meeting small zone on one end side of the meeting zone toward the N-th meeting small zone on the other end side.

Cooling of the hot-rolled steel sheet using cooling water from the spray nozzles may be performed in a nuclear boiling region.

According to another aspect of the present invention, there is provided an apparatus configured to cool a hot-rolled steel sheet after finish rolling of a continuous hot rolling process, the cooling apparatus including: spray nozzles configured to jet cooling water to a steel sheet conveyance region in a width direction of the steel sheet conveyance region. The steel sheet conveyance region is a region that the hot-rolled steel sheet occupies on conveyor rolls, a pair of spray nozzles is arranged on both lateral sides in the width direction of the steel sheet conveyance region, and a plurality of spray nozzle pairs are aligned in a conveyance direction of the hot-rolled steel sheet. The spray nozzle is placed in a manner that, in regard to a collision region of cooling water jetted from the spray nozzle at the steel sheet conveyance region, a far end in a jet direction is positioned at an end of the steel sheet conveyance region, and a near end is positioned on an inner side of the steel sheet conveyance region. The spray nozzle pair is arranged in a manner that the near ends of two collision regions coincide in the width direction to form a meeting.

The meeting may be positioned within a meeting zone marked off at the center in the width direction of the steel sheet conveyance region, a width of the meeting zone may satisfy Formula (1) below, and the spray nozzle pairs adjacent to each other in the conveyance direction may be arranged in a manner that an interval in the width direction between the respective meetings is a length of the collision region in the conveyance direction or more.

$$W \leq (D+2d)-(D+d)\sin\theta_2/\sin(\theta_1+\theta_2) \quad (1)$$

W is the width of the meeting zone, D is a width of the steel sheet conveyance region, d is a horizontal distance between a jet of the spray nozzle and an end of the steel sheet conveyance region on a side near to the jet, $\theta_1$ is a spray jet angle, and $\theta_2$ is a spray installation angle (an angle formed by a perpendicular from the jet of the spray nozzle and a line connecting the jet of the spray nozzle and the center in the width direction of the steel sheet conveyance region).

A cooling zone in which cooling water is jetted from the plurality of spray nozzle pairs toward the steel sheet conveyance region may be divided into a plurality of cooling small zones in the conveyance direction, N spray nozzle pairs (N is an integer) may be arranged in the cooling small zone, the meeting zone may be divided into N meeting small zones at equal intervals in the width direction, one meeting may be placed in each meeting small zone in the cooling small zone, and the meetings in the cooling small zone may be arranged from an upstream side toward a downstream side in the conveyance direction, from the meeting small zone at one end of the meeting zone toward the meeting small zone at the other end.

The cooling small zone may be divided into k divided cooling small zones (k is a submultiple of N) in the conveyance direction, and in the i-th divided cooling small zone (i is an integer of 1 to k) in the conveyance direction, the meetings may be arranged in the i-th to (jk+i)-th meeting small zones (j is an integer of 1 to (N/k−1), from the first meeting small zone on one end side of the meeting zone toward the N-th meeting small zone on the other end side.

Advantageous Effects of Invention

According to the present invention, a hot-rolled steel sheet after finish rolling of a continuous hot rolling process can be cooled appropriately and uniformly.

DESCRIPTION OF EMBODIMENTS

<Hot Rolling Facility>

Figure 1:
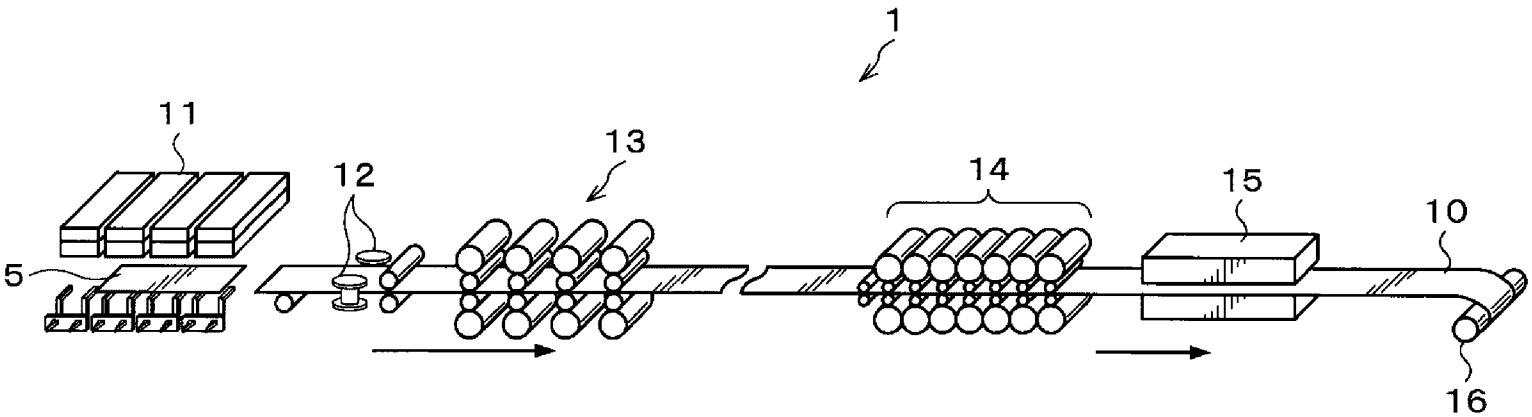
FIG. 1 is an explanatory diagram illustrating an overview of the configuration of a continuous hot rolling facility including a cooling apparatus in the present embodiment.

Hereinbelow, embodiments of the present invention are described. FIG. 1 is an explanatory diagram illustrating an overview of the configuration of a hot rolling facility 1 including a cooling apparatus in the present embodiment.

In the continuous hot rolling facility 1, a heated slab 5 is continuously rolled by being vertically sandwiched between rolls and is thereby thinned to the minimum sheet thickness of 1 mm, and a hot-rolled steel sheet 10*a* (hereinafter, a reference numeral "10" in the drawings indicates a steel sheet conveyance region 10 or the hot-rolled steel sheet 10*a*, as will be described later) is wound. The continuous hot rolling facility 1 includes a heating furnace 11 for heating the slab 5, a width-direction rolling mill 12 that rolls the slab 5 that has been heated in the heating furnace 11 in the width direction, a rough rolling mill 13 that rolls the slab 5 that has been rolled in the width direction while vertically sandwiching the slab 5 to make a rough bar, a finish rolling mill 14 that further performs finish hot rolling continuously on the rough bar to a predetermined thickness, a cooling apparatus 15 that uses cooling water to cool the hot-rolled steel sheet 10*a* which has been subjected to finish hot rolling by the finish rolling mill 14, and a winding apparatus 16 that winds the hot-rolled steel sheet 10*a* that has been cooled by the cooling apparatus 15 into a coil form. The above is a general configuration, and the configuration is not limited thereto.

In the heating furnace 11, the treatment of heating the slab 5, which is carried in from the outside via an inlet, to a predetermined temperature is performed. When the heating treatment in the heating furnace 11 is finished, the slab 5 is conveyed to the outside of the heating furnace 11, and is then subjected to a rolling process by the rough rolling mill 13.

The conveyed slab 5 is rolled by the rough rolling mill 13 into a rough bar with a thickness of approximately 30 to 60 mm, and is conveyed to the finish rolling mill 14.

In the finish rolling mill 14, the conveyed rough bar is rolled into the hot-rolled steel sheet 10*a* with a sheet thickness of approximately several millimeters. The rolled hot-rolled steel sheet 10*a* is conveyed by conveyor rolls 17, and is transferred to the cooling apparatus 15. The hot-rolled steel sheet 10*a* is cooled by the cooling apparatus 15, and is wound in a coil form by the winding apparatus 16.

<Cooling Apparatus>

Figure 2:
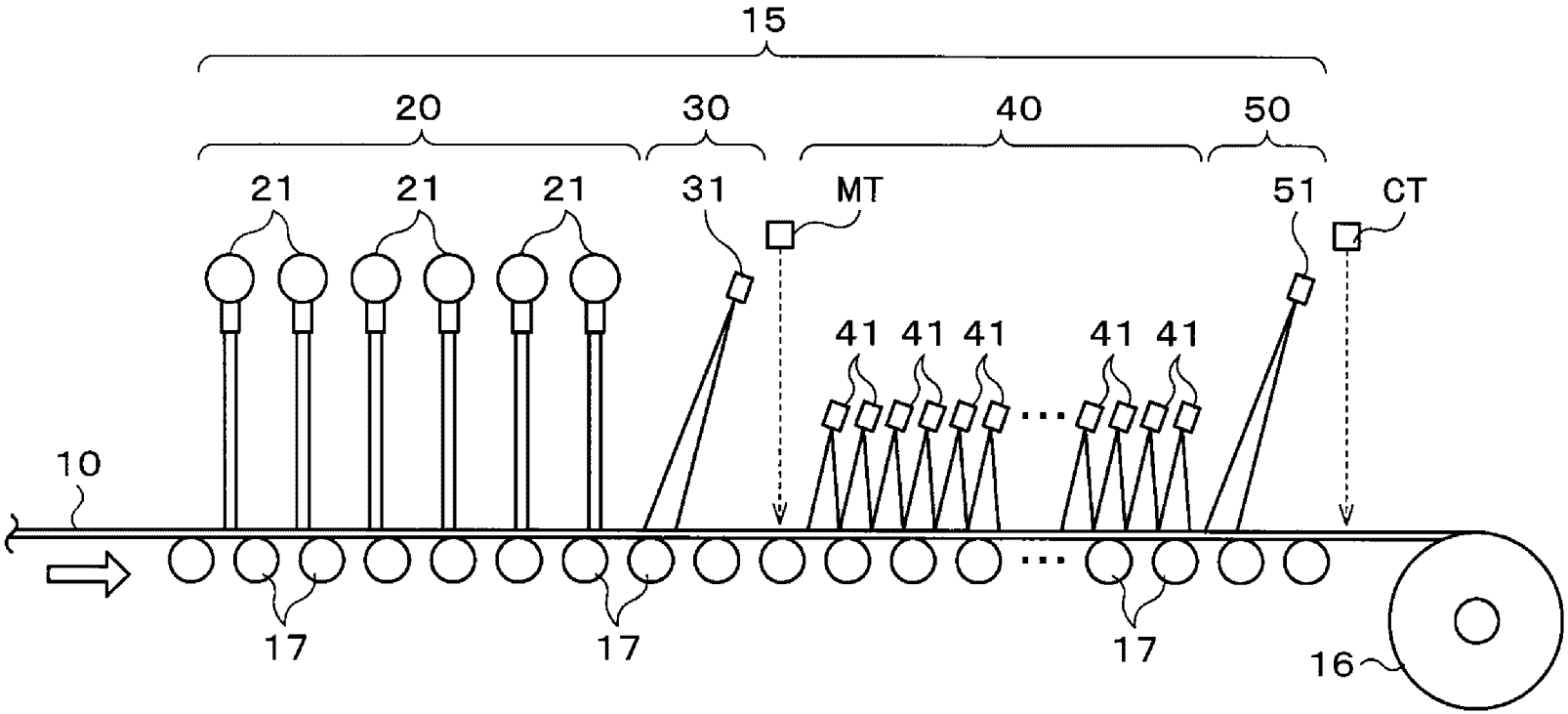
FIG. 2 is a side view illustrating an overview of the configuration of a cooling apparatus according to the present embodiment.
Figure 3:
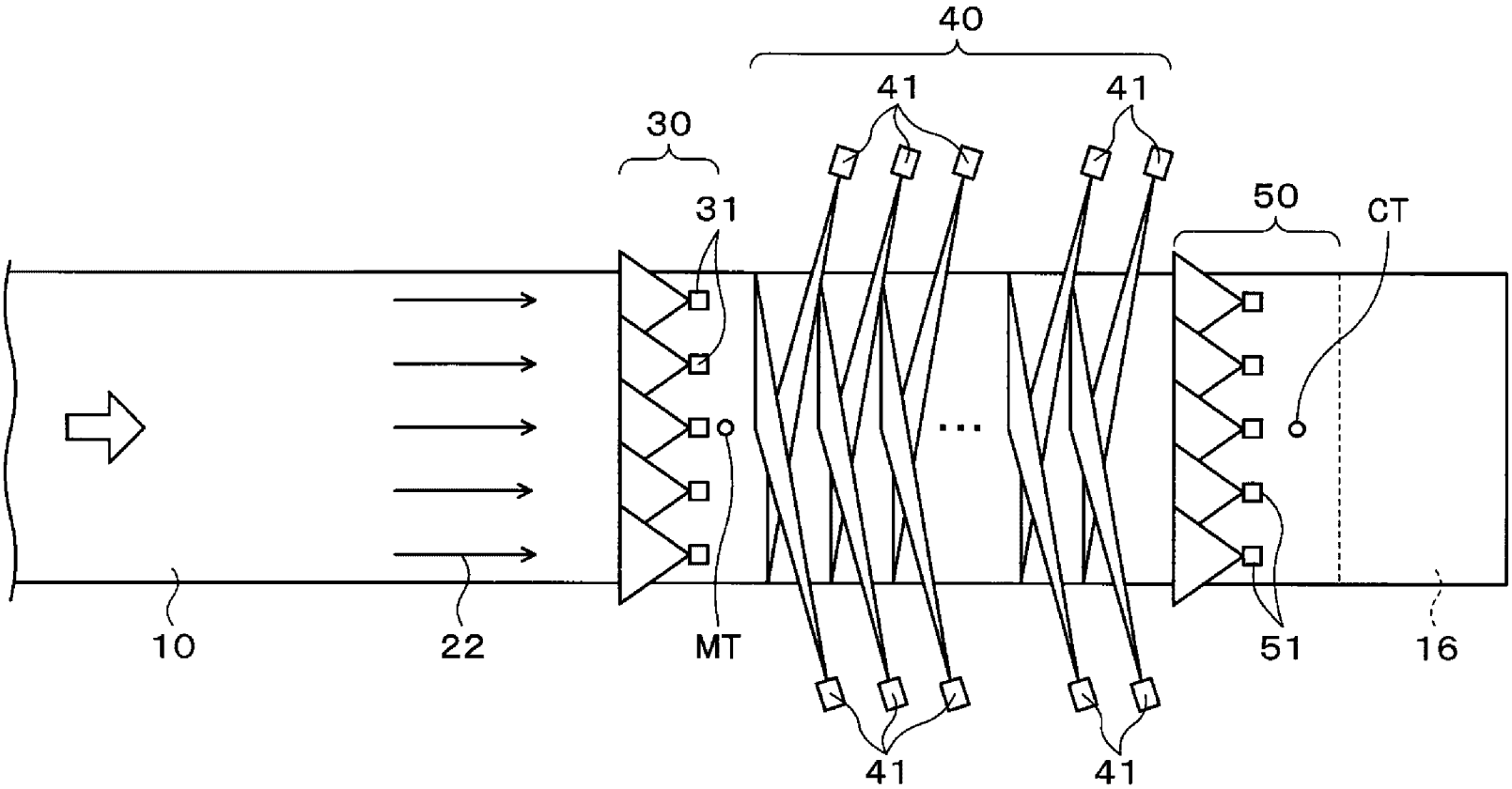
FIG. 3 is a plan view illustrating an overview of the configuration of a cooling apparatus according to the present embodiment.

Next, details of the cooling apparatus 15 according to the present embodiment are described. FIG. 2 is a schematic side view of the cooling apparatus 15, and FIG. 3 is a schematic plan view of the cooling apparatus 15. The cooling apparatus 15 includes, as illustrated in FIG. 2, an upper cooling apparatus 20 placed above the hot-rolled steel sheet 10*a* that is conveyed on the conveyor rolls 17 of a run-out table and a lower cooling apparatus (not illustrated) placed below the hot-rolled steel sheet 10*a*.

The upper cooling apparatus 20 includes a plurality of cooling water nozzles 21 that jet cooling water from above the hot-rolled steel sheet 10*a* toward the upper surface of the hot-rolled steel sheet 10*a* vertically downward. As the cooling water nozzle 21, for example, a slit laminar nozzle or a pipe laminar nozzle is used. The plurality of cooling water nozzles 21 are aligned along the conveyance direction of the hot-rolled steel sheet 10*a* (the bold-arrow-direction in the drawing). As the cooling water nozzle 21, other nozzles may be used as well as these nozzles.

A water removing apparatus 30 for removing on-sheet water 22, which is cooling water having been jetted from the upper cooling apparatus 20 and flowing with the steel sheet, is provided on the downstream side in the conveyance direction with respect to the upper cooling apparatus 20. As illustrated in FIG. 3, the water removing apparatus 30 of this embodiment uses a plurality of spray apparatuses 31 for water removal, and is configured to jet a fluid for water removal, for example, water, from each spray apparatus 31 toward the upstream in the conveyance direction.

A side spray apparatus 40 is provided on the downstream side in the conveyance direction with respect to the water removing apparatus 30. In this embodiment, a plurality of spray nozzles 41 are installed along the conveyance direction, on both lateral sides in the width direction of the steel sheet conveyance region 10 (an existence region of the hot-rolled steel sheet 10*a* conveyed on a pass line). Note that for convenience in illustration, FIG. 3 illustrates five spray nozzles 41 on each side, i.e., ten spray nozzles 41 in total, but the installed number is not limited to this and can be selected appropriately as necessary.

Here, the steel sheet conveyance region 10 is a region that the hot-rolled steel sheet 10*a* occupies on the conveyor rolls 17. That is, the steel sheet conveyance region 10 is on a line connecting the apices of the conveyor rolls 17 in the side view, and is a conveyance region in the case where, in the planar view, the dimension in the width direction of the hot-rolled steel sheet 10*a* is the maximum producible dimension (maximum width). In the following description, it is assumed that the width of the steel sheet conveyance region 10 and the width of the hot-rolled steel sheet 10*a* coincide, and the reference numeral "10" in the drawings indicates the steel sheet conveyance region 10 or the hot-rolled steel sheet 10*a*, depending on a scene of application. Note that since the width of the steel sheet conveyance region 10 is the maximum width of the hot-rolled steel sheet 10*a* as described above, in the case where the hot-rolled steel sheet 10*a* having a width narrower than the maximum width is cooled by the side spray apparatus 40, cooling water that is jetted to a portion on the end side in the width direction of the steel sheet conveyance region 10, which corresponds to the difference, falls below the pass line of the hot-rolled steel sheet 10*a* without colliding with the hot-rolled steel sheet 10*a*.

A water removing apparatus 50 is provided on the downstream side in the conveyance direction with respect to the side spray apparatus 40. The water removing apparatus 50 of this embodiment uses a plurality of spray apparatuses 51 for water removal, and is configured to jet a fluid for water removal, for example, water, from each spray apparatus 51 toward the upstream in the conveyance direction.

In the planar view, a temperature sensor MT that measures the temperature of the hot-rolled steel sheet 10*a* is placed between the water removing apparatus 30 and the side spray apparatus 40, and a temperature sensor CT that measures the temperature of the hot-rolled steel sheet 10*a* is placed between the water removing apparatus 50 and the winding apparatus 16. A temperature signal from the temperature sensor MT is used for control (e.g., feedback control) of the upper cooling apparatus 20, for example, and a temperature signal from the temperature sensor CT is used for control (e.g., feedback control) of the side spray apparatus 40, for example.

The cooling apparatus 15 according to the present embodiment has the configuration described above, and the hot-rolled steel sheet 10*a* having been rolled to a predetermined sheet thickness by the finish rolling mill 14 is first cooled by cooling water from the cooling water nozzles 21 of the upper cooling apparatus 20 (as mentioned above, the lower cooling apparatus is not illustrated). After that, water removal is performed by the water removing apparatus 30. Then, the hot-rolled steel sheet 10*a* from which water has been removed is further cooled by the side spray apparatus 40.

Note that in the present embodiment, the hot-rolled steel sheet 10*a* is cooled to approximately 200° C. in the cooling apparatus 15. If the hot-rolled steel sheet 10*a* can be appropriately and uniformly cooled to approximately 200° C. and wound in this manner, for example, the hot-rolled steel sheet 10*a* with improved deformability can be produced advantageously by generating tempered martensite in the hot-rolled steel sheet 10*a* adjusted to predetermined components, during allowing to cool after winding. In addition, in this case, there is an effect that formation of red scale on the hot-rolled steel sheet 10*a* can be suppressed by setting a winding temperature to a martensite transformation start temperature (Ms point) or less and greater than the boiling point of water.

<Side Spray Apparatus>

Figure 4:
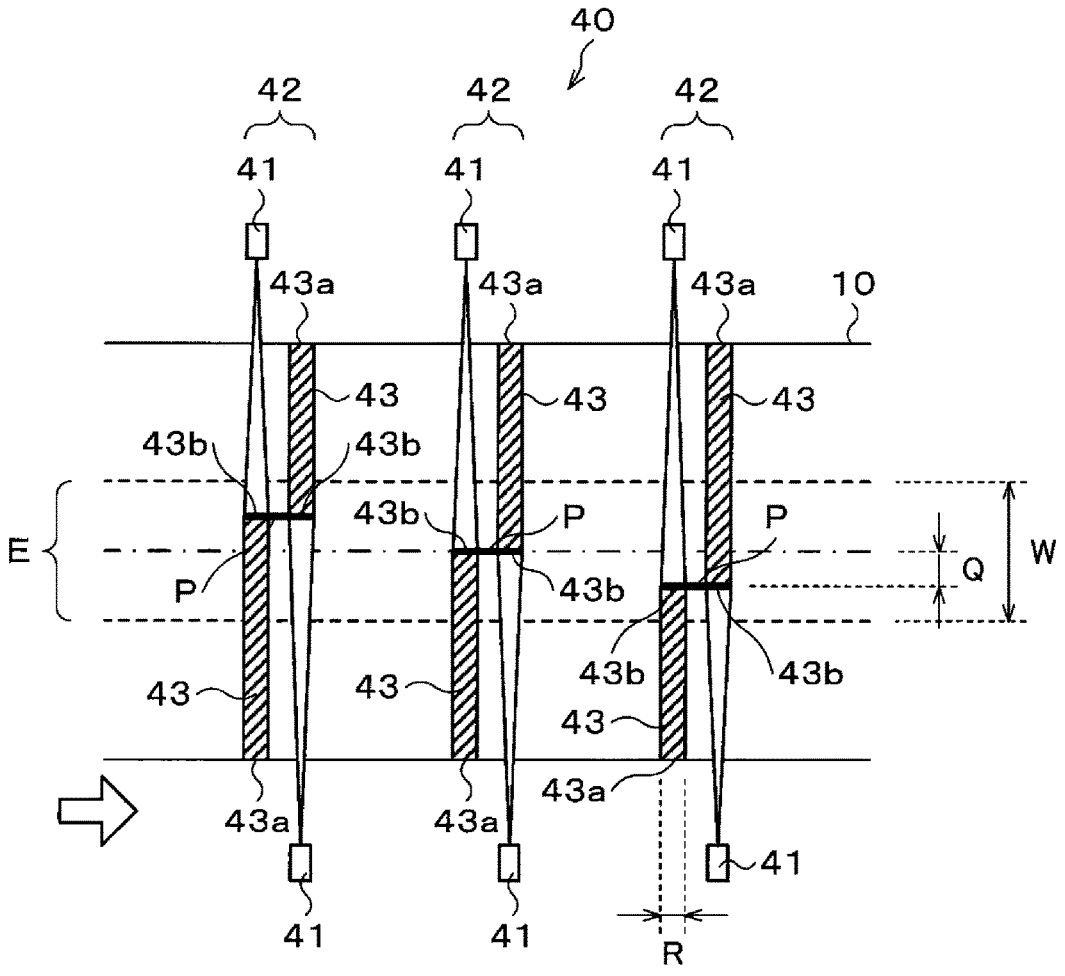
FIG. 4 is an explanatory diagram illustrating a collision region of cooling water jetted from a spray nozzle of a side spray apparatus at a hot-rolled steel sheet.

Next, details of the side spray apparatus 40 described above are described. In the side spray apparatus 40, as illustrated in FIG. 4, a pair of spray nozzles 41 and 41 is arranged on lateral sides in the width direction of the steel sheet conveyance region 10. In addition, a plurality of spray nozzle pairs 42 each constituted by the pair of spray nozzles 41 and 41 are aligned in the conveyance direction of the hot-rolled steel sheet 10*a*. Note that, as mentioned above, the installed numbers of the spray nozzles 41 and the spray nozzle pairs 42 can be selected appropriately as necessary.

Figure 5:
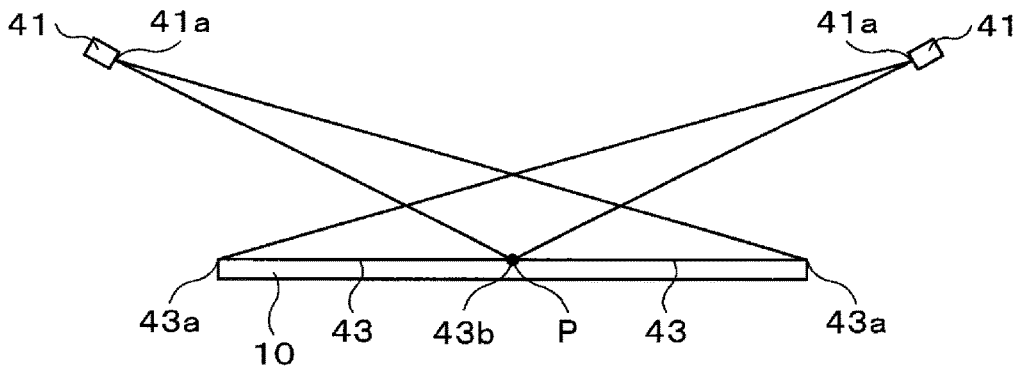
FIG. 5 is an explanatory diagram illustrating an arrangement of a pair of spray nozzles in a front view in a conveyance direction.

As illustrated in FIG. 5, the spray nozzle 41 jets cooling water to the steel sheet conveyance region 10 in an oblique direction from above and in the width direction of the steel sheet conveyance region 10. In addition, as illustrated in FIG. 4, in regard to a collision region 43 of cooling water jetted from the spray nozzle 41 at the steel sheet conveyance region 10, a far end 43*a* in the jet direction (the end on the opposite side to the spray nozzle 41) is positioned at an end of the steel sheet conveyance region 10, and a near end 43*b* (the end on the spray nozzle 41 side) is positioned on the inner side of the steel sheet conveyance region 10. In the spray nozzle pair 42, the near ends 43*b* and 43*b* of two collision regions 43 and 43 coincide in the width direction to form a meeting P (indicated by a bold line in FIG. 4). Here, the near ends 43*b* and 43*b* of two collision regions 43 and 43 coinciding in the width direction means that, as illustrated in FIGS. 4 and 5, the near end 43*b* of the collision region 43 on one width side of the steel sheet conveyance region 10 and the near end 43*b* of the collision region 43 on the other width side coincide without overlap or separation at the meeting P, as viewed in FIG. 5, and the collision regions 43 in the width direction in the steel sheet conveyance region 10 look like one collision region continuous from one end to the other end of the steel sheet conveyance region 10.

In this case, since the spray nozzle 41 is placed so as to jet cooling water to the steel sheet conveyance region 10 obliquely from above at a predetermined jet angle, even if the on-sheet water 22 remains on the upper surface of the hot-rolled steel sheet 10*a*, the hot-rolled steel sheet 10*a* can be cooled while the on-sheet water 22 is drained to the end side (the far end side) of the hot-rolled steel sheet 10*a*.

In addition, since the meeting P of the collision regions 43 and 43 is formed in the spray nozzle pair 42, these collision regions 43 and 43 do not overlap in the width direction of the steel sheet conveyance region 10, and cover the entire width direction. Consequently, cooling unevenness due to overlap of collision regions in the width direction in a conventional case can be suppressed, and the hot-rolled steel sheet 10*a* can be cooled uniformly in the width direction.

<Meeting Zone>

The meeting P is a portion where the near ends 43*b* and 43*b* of two collision regions 43 and 43 are in contact with each other, and the meeting P involves a destabilizing element for a cooling effect in terms of industry, as compared with a central part in a single collision region 43, because, for example, fluctuation of the position of the near end 43*b* to some extent has to be permitted in terms of industry. Therefore, when a case where the meetings P of all the spray nozzle pairs 42 are aligned in a central part in the width direction of the steel sheet conveyance region 10 is assumed as an extreme case, it is predicted that in-sheet variation in cooling stop temperature increases. In regard to this, the present inventors have found as a result of extensive studies that it is preferable to disperse the meetings P of all the spray nozzle pairs 42 within a predetermined width.

Specifically, as illustrated in FIG. 4, the meeting P is positioned within a meeting zone E marked off at the center in the width direction of the steel sheet conveyance region 10. A width W of the meeting zone E satisfies Formula (1) below.

$$W \leq (D+2d)-(D+d)\sin\theta_2/\sin(\theta_1+\theta_2) \quad (1)$$

W: the width of the meeting zone E in the width direction of the steel sheet conveyance region 10

D: a width of the steel sheet conveyance region 10 d: a horizontal distance between a jet 41*a* of the spray nozzle 41 and an end of the steel sheet conveyance region 10 on the side near to the jet 41*a*

$\theta_1$: a spray jet angle (a jet angle in the vertical direction of cooling water jetted from the spray nozzle 41)

$\theta_2$: a spray installation angle (an angle formed by a perpendicular from the jet 41*a* of the spray nozzle 41 and a line connecting the jet 41*a* of the spray nozzle 41 and the center in the width direction of the steel sheet conveyance region 10)

Figure 6:
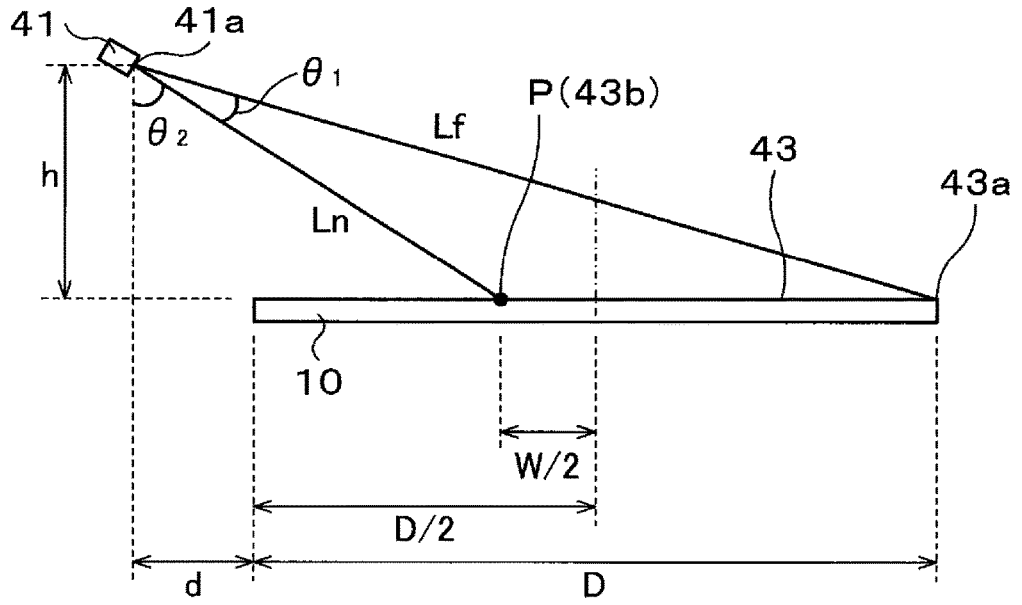
FIG. 6 is an explanatory diagram illustrating dimensions needed for calculating a width of a meeting zone.

In deriving the width W of the meeting zone E, the present inventors focused on a range of cooling water jetted from the spray nozzle 41 to the steel sheet conveyance region 10. As illustrated in FIG. 6, a far distance from the jet 41*a* of the spray nozzle 41 to the far end 43*a* of the collision region 43 is denoted by Lf, and a near distance from the jet 41*a* of the spray nozzle 41 to the near end 43*b* of the collision region 43 is denoted by Ln. Note that FIG. 6 illustrates a case where the meeting P is positioned at an end of the meeting zone E.

Figure 7:
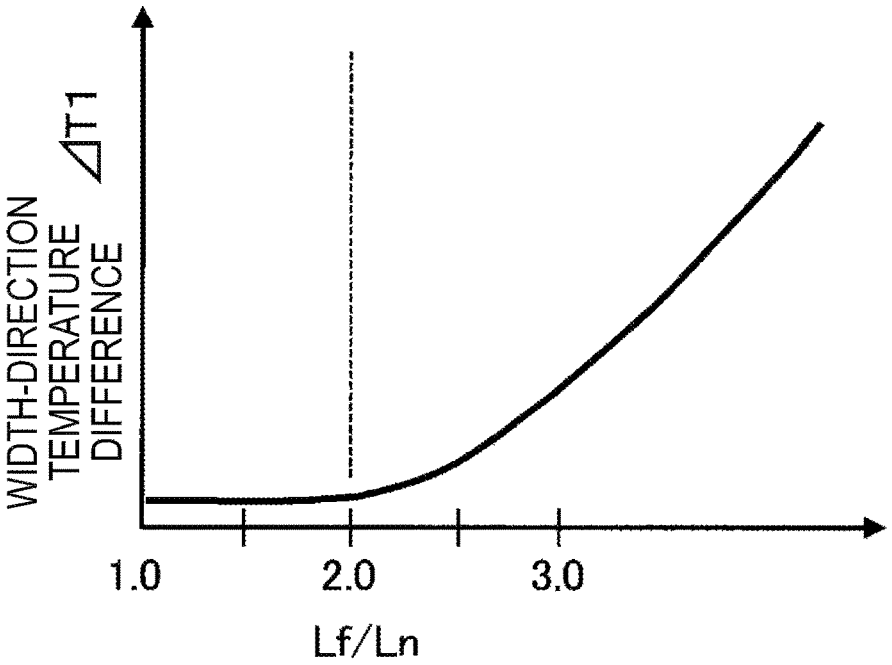
FIG. 7 is an explanatory diagram showing a correlation between Lf/Ln and a width-direction temperature difference ΔT1 of a hot-rolled steel sheet.

The width W of the meeting zone E is derived in a manner that Lf/Ln≤2 is satisfied. Now, a ground for Lf/Ln≤2 will be described. The present inventors carried out simulation of cooling of the hot-rolled steel sheet 10*a* using the side spray apparatus 40, and found a tendency shown in FIG. 7. FIG. 7 shows a width-direction temperature difference ΔT1 of the upper surface of the hot-rolled steel sheet 10*a* (vertical axis) when Lf/Ln (horizontal axis) is changed. The width-direction temperature difference ΔT1 is a difference between a maximum temperature and a minimum temperature in the width direction of the hot-rolled steel sheet 10*a* after the hot-rolled steel sheet 10*a* is cooled and recuperates (for example, immediately before being wound by the winding apparatus 16).

According to FIG. 7, in the case where Lf/Ln>2, the width-direction temperature difference ΔT1 of the hot-rolled steel sheet 10*a* increases. This is because an increase in Lf/Ln increases a difference in force when cooling water collides with the far end 43*a* and the near end 43*b*, increasing a difference in cooling performance between the two cases. In contrast, in the case where Lf/Ln≤2, cooling water after colliding with the near side flows to the far side, so that cooling on the far side is performed; thus, the width-direction temperature difference ΔT1 of the hot-rolled steel sheet 10*a* is small, and variation in cooling performance in the width direction of the hot-rolled steel sheet 10*a* is small. Hence, Lf/Ln≤2 is preferable in order to cool the hot-rolled steel sheet 10*a* uniformly in the width direction.

The far distance Lf and the near distance Ln are expressed respectively by Formulas (2) and (3) below, on the basis of the geometric relationship illustrated in FIG. 6.

$$Lf=(D+d)/\cos\{90°-(\theta_1+\theta_2)\} \quad (2)$$

$$Ln=(D/2+d-W/2)/\cos(90°-\theta_2) \quad (3)$$

Formulas (2) and (3) above are put into Lf/Ln≤2, and Formula (1) below, which is mentioned above, is derived through organization in regard to the width W of the meeting zone E.

$$W\leq(D+2d)-(D+d)\sin\theta_2/\sin(\theta_1+\theta_2) \quad (1)$$

Note that in the case where, for example, the width D of the steel sheet conveyance region 10 is 2000 mm, the horizontal distance d between the spray nozzle 41 and the end of the steel sheet conveyance region 10 is 250 mm, the spray jet angle $\theta_1$ is 20°, and the spray installation angle $\theta_2$ is 60°, the width W of the meeting zone E at which Lf/Ln=2 holds is 500 mm. Further, in the case where, for example, the width D of the steel sheet conveyance region 10 is 2000 mm, the horizontal distance d between the spray nozzle 41 and the end of the steel sheet conveyance region 10 is 250 mm, the spray jet angle $\theta_1$ is 20°, and the spray installation angle $\theta_2$ is 45°, the width W of the meeting zone E at which Lf/Ln=2 holds is 785 mm.

In addition, a practical installation height h of the spray nozzle 41 (a height h from the steel sheet conveyance region 10 to the jet 41*a* of the spray nozzle 41) is approximately 400 to 600 mm. If the installation height is higher than 600 mm, cooling performance in the far end 43*a* decreases. On the other hand, if the installation height is lower than 400 mm, the spray jet angle $\theta_1$ needs to be made small in order to secure the collision region 43, in which case it is difficult to fabricate the spray nozzle 41.

<Interval in Width Direction Between Meetings>

As described above, the meeting P is a portion where the near ends 43*b* and 43*b* of two collision regions 43 and 43 are in contact with each other, and involves a destabilizing element for a cooling effect in terms of industry; hence, the present inventors have found as a result of extensive studies that it is preferable to separate the meetings P and P of the spray nozzle pairs 42 and 42 adjacent to each other in the conveyance direction by a predetermined distance or more.

Specifically, as illustrated in FIG. 4, an interval Q in the width direction between the meetings P and P of the spray nozzle pairs 42 and 42 adjacent to each other in the conveyance direction is set to a length R of the collision region 43 in the conveyance direction or more.

Figure 8:
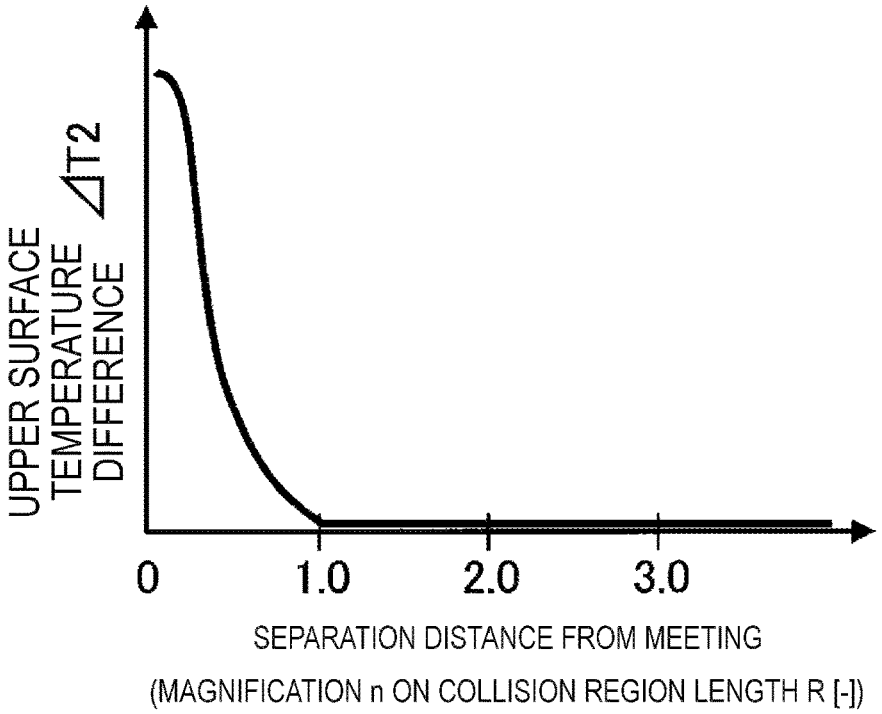
FIG. 8 is an explanatory diagram showing a correlation between a separation distance from a meeting and an upper surface temperature difference ΔT2 of a hot-rolled steel sheet.

In the simulation of cooling of the hot-rolled steel sheet 10*a* using the side spray apparatus 40, the present inventors assumed a temperature difference of the meeting P with respect to surrounding temperature, which occurs in the meeting P involving a destabilizing element for a cooling effect in terms of industry, and found a tendency shown in FIG. 8 in regard to a range of an influence that the temperature difference exerts on surroundings. FIG. 8 shows the relationship between a separation distance from the meeting P in the width direction of the steel sheet (horizontal axis) and an upper surface temperature difference ΔT2 of the hot-rolled steel sheet 10*a* (vertical axis). In FIG. 8, in regard to the separation distance from the meeting P, the destabilizing element in terms of industry exerts an influence (the upper surface temperature difference ΔT2 increases) in a range of the length R of the collision region 43 in the conveyance direction as will be described later; hence, this length R is used as a reference, and a magnification n (n is an integer) on the length R is shown as the separation distance from the meeting P. In addition, the upper surface temperature difference ΔT2 of the hot-rolled steel sheet 10*a* is a difference between an upper surface temperature of the hot-rolled steel sheet 10*a* in the meeting P and an upper surface temperature of the hot-rolled steel sheet 10*a* at a measurement point away from the meeting P by the separation distance (the magnification n on the length R).

According to FIG. 8, in the case where n is smaller than 1, that is, in the case where the measurement point is near to the meeting P, the upper surface temperature difference ΔT2 is large. In contrast, in the case where n is 1 or more, that is, in the case where the measurement point is far from the meeting P, the upper surface temperature difference ΔT2 is small, being almost zero.

In such a case, in regard to the interval Q in the width direction between the meetings P and P of the spray nozzle pairs 42 and 42 adjacent to each other in the conveyance direction, in the case where n is smaller than 1, that is, in the case where the interval Q is smaller than the length R of the collision region 43 in the conveyance direction, a large upper surface temperature difference ΔT2 with respect to one meeting P and a large upper surface temperature difference ΔT2 with respect to another meeting P overlap in the conveyance direction. Then, the hot-rolled steel sheet 10*a* cannot be cooled uniformly in the width direction. In contrast, in the case where n is 1 or more and the interval Q is the length R or more, the upper surface temperature difference ΔT2 is small, and thus, ununiform cooling in the width direction of the hot-rolled steel sheet 10*a* can be suppressed. Hence, it is preferable that the interval Q in the width direction between the meetings P be the length R of the collision region 43 in the conveyance direction or more.

Note that in the case where, for example, the width D of the steel sheet conveyance region 10 is 2000 mm, the horizontal distance d between the spray nozzle 41 and the end of the steel sheet conveyance region 10 is 250 mm, a jet angle $\theta_3$ in the horizontal direction of cooling water jetted from the spray nozzle 41 is 3°, the length R of the collision region 43 in the conveyance direction is 65 mm (=1250 mm×tan(3°/2)×2).

<Arrangement of Meetings>

Figure 9:
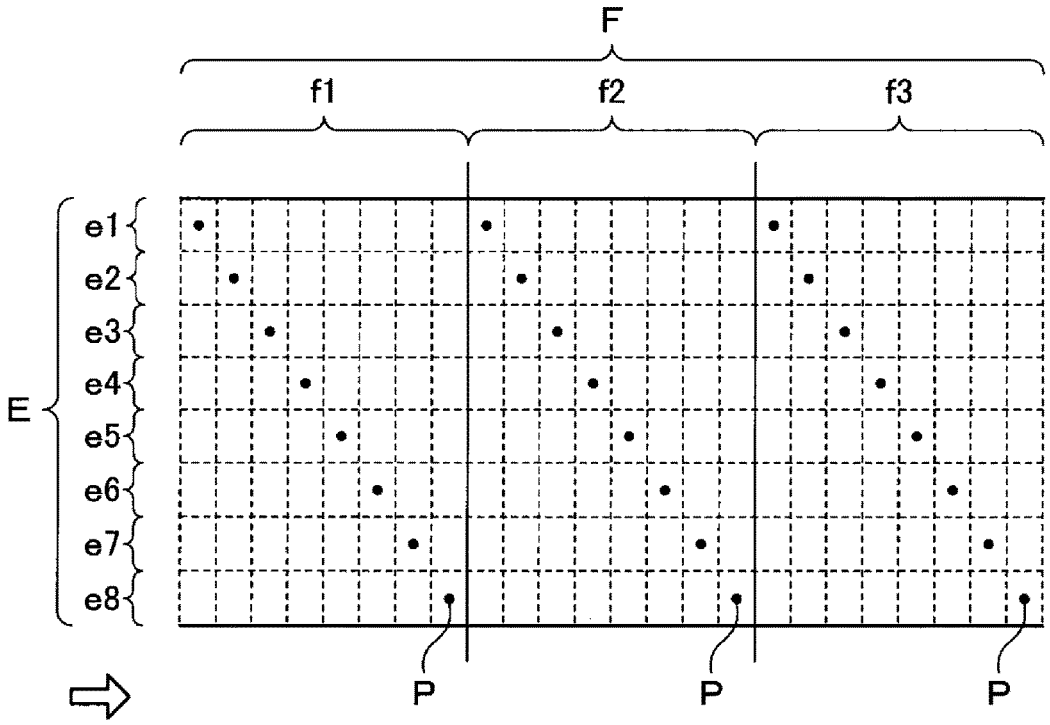
FIG. 9 is an explanatory diagram illustrating an example of an arrangement of meetings.

As illustrated in FIG. 9, the meetings P are arranged in a staggered pattern in the meeting zone E.

The meeting zone E is divided into N meeting small zones e, eight meeting small zones e (meeting small zones e1 to e8)

in the present embodiment, at equal intervals in the width direction. Note that N is an integer of 2 or more, and can be selected freely.

In addition, in the side spray apparatus 40, a region in which cooling water is jetted from all the spray nozzle pairs 42 toward the steel sheet conveyance region 10 is referred to as a cooling zone F; the cooling zone F is divided into a plurality of cooling small zones f in the conveyance direction. In each cooling small zone f, N spray nozzle pairs 42, which are the same in number as the meeting small zones e, are arranged. Note that for convenience in illustration, FIG. 9 illustrates cooling small zones f1 to f3, but the number of the cooling small zones f is not limited to this and can be selected appropriately as necessary, and the number is decided in accordance with the number of the spray nozzle pairs 42 in the side spray apparatus 40. For example, in the case where there are M×N spray nozzle pairs 42 (M is an integer of 2 or more), M cooling small zones f are provided.

In one cooling small zone f, one meeting P is placed in one meeting small zone e. Further, in one cooling small zone f, the meetings P are arranged from the upstream side toward the downstream side in the conveyance direction, from the meeting small zone e1 at one end of the meeting zone E toward the meeting small zone e8 at the other end.

Here, in the case where the meetings P and P of the spray nozzle pairs 42 and 42 adjacent to each other in the conveyance direction are arranged in the same meeting small zone e, overcooling may be caused by overlap of the meetings P and P. In this point, in the present embodiment, since the meetings P are arranged in a staggered pattern in one cooling small zone f, the meetings P can be dispersed in the width direction, and a section subjected to overcooling can be minimized. Consequently, the hot-rolled steel sheet 10*a* can be cooled uniformly in the width direction.

Figure 10:
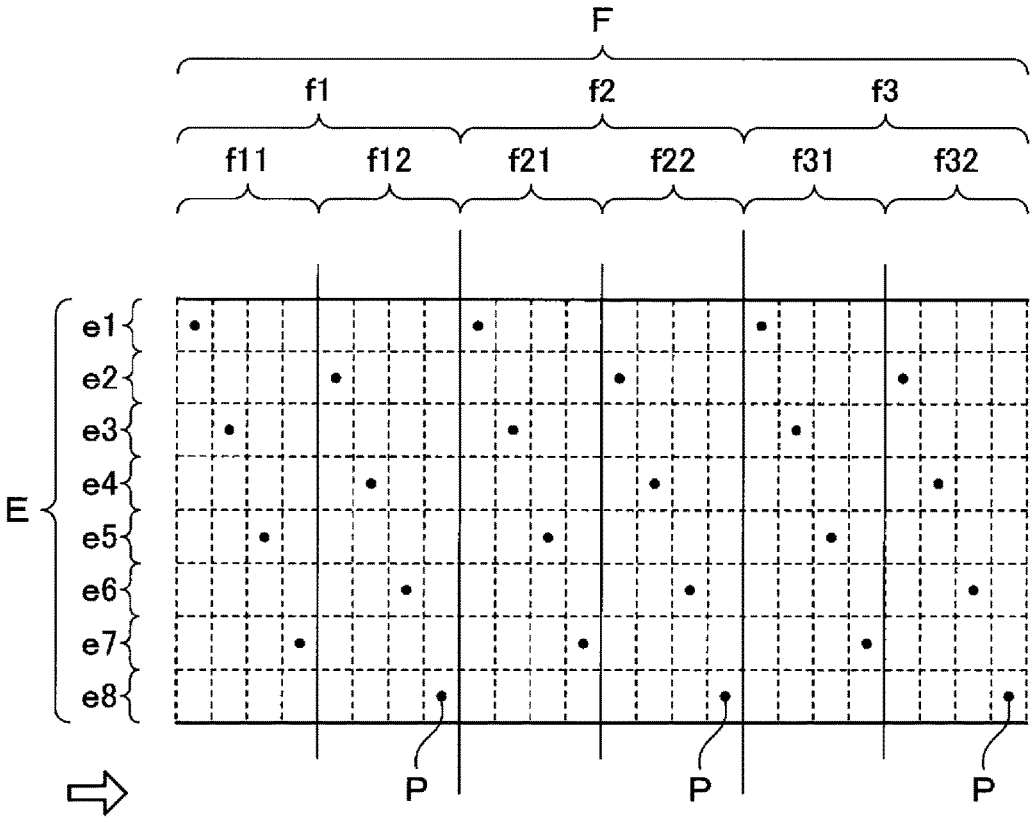
FIG. 10 is an explanatory diagram illustrating an example of an arrangement of meetings.

Moreover, as illustrated in FIG. 10, one cooling small zone f1 (f2, f3) may be further divided into k divided cooling small zones f, two divided cooling small zones f11, f12 (f21, f22, f31, f32) in the present embodiment, in the conveyance direction. Note that k is a submultiple of N and can be selected freely.

In the cooling small zone f1, in the first divided cooling small zone f11 in the conveyance direction, the meetings P are arranged in the meeting small zones e1, e3, e5, e7. In the second divided cooling small zone f12 in the conveyance direction, the meetings P are arranged in the meeting small zones e2, e4, e6, e8. In the case where the cooling small zone f1 is divided into two in the conveyance direction in this manner, in the cooling small zone f1, one meeting P is placed for each two meeting small zones e in the width direction. Note that the meetings P are arranged in a similar manner also in the cooling small zones f2, f3.

This arrangement of the meetings P is generalized as follows. In the i-th divided cooling small zone f (i is an integer of 1 to k) in the conveyance direction, the meetings P are arranged in the i-th to (jk+i)-th meeting small zones (j is an integer of 1 to (N/k−1), from the first meeting small zone on one end side of the meeting zone E toward the N-th meeting small zone on the other end side.

Note that the number k into which one cooling small zone f is divided is not limited to two, as long as it is a submultiple of N. Since N is 8 in the above example, the number k into which the cooling small zone f is divided may be four.

Thus, also in the example illustrated in FIG. 10, an effect similar to that of the arrangement of the meetings P illustrated in FIG. 4 can be obtained, that is, the meetings P can be dispersed in the width direction and a section subjected to overcooling can be minimized. Furthermore, in the case where one cooling small zone f is divided into two or more, the meetings P can be further dispersed in the width direction. Consequently, the hot-rolled steel sheet 10*a* can be cooled further uniformly in the width direction.

Note that the arrangement of the meetings P is not limited to a staggered pattern, and may be any arrangement in which the meetings P are dispersed in the width direction, and may be, for example, an arrangement such as a sine curve pattern.

<Nuclear Boiling Cooling in Side Spray Apparatus>

In the side spray apparatus 40, cooling of the hot-rolled steel sheet 10*a* using cooling water from the spray nozzle 41 is performed in a nuclear boiling region.

Here, in cooling of the hot-rolled steel sheet 10*a*, a boiling state of cooling water on the hot-rolled steel sheet 10*a* fluctuates depending on an upper surface temperature of the hot-rolled steel sheet 10*a*. Specifically, fluctuation proceeds in order from a film boiling region to a transition boiling region and then a nuclear boiling region from the high-temperature side of the upper surface temperature.

In the film boiling region, when cooling water is jetted to the upper surface of the hot-rolled steel sheet 10*a*, cooling water evaporates before reaching the hot-rolled steel sheet 10*a* or immediately after reaching the hot-rolled steel sheet 10*a*, and the upper surface of the hot-rolled steel sheet 10*a* is covered by a vapor film. In this cooling, the vapor film on the upper surface of the hot-rolled steel sheet 10*a* inhibits transfer of heat, which makes a heat transfer coefficient of the hot-rolled steel sheet 10*a* low, resulting in low cooling performance.

In the transition boiling region, when cooling water is jetted to the upper surface of the hot-rolled steel sheet 10*a*, a place where a vapor film comes into contact with the upper surface of the hot-rolled steel sheet 10*a* and cooling water comes into contact with the upper surface of the hot-rolled steel sheet 10*a* are mixed. In this transition boiling region, a heat transfer coefficient increases as the upper surface temperature of the hot-rolled steel sheet 10*a* decreases. Therefore, a place where the upper surface temperature of the hot-rolled steel sheet 10*a* is high is difficult to cool, and a place where the upper surface temperature is low is rapidly cooled, which causes local variation in the upper surface temperature of the hot-rolled steel sheet 10*a*. Then, the hot-rolled steel sheet 10*a* cannot be cooled uniformly.

In the nuclear boiling region, when cooling water is jetted to the upper surface of the hot-rolled steel sheet 10*a*, a vapor film does not occur on the upper surface of the hot-rolled steel sheet 10*a*, and cooling water directly comes into contact with the upper surface of the hot-rolled steel sheet 10*a*. Therefore, in the nuclear boiling region, the hot-rolled steel sheet 10*a* has a high heat transfer coefficient, and cooling performance is high.

In the present embodiment, cooling of the hot-rolled steel sheet 10*a* in the side spray apparatus 40 is performed in the nuclear boiling region; thus, the hot-rolled steel sheet 10*a* can be cooled uniformly with high cooling performance. In other words, the temperature of the hot-rolled steel sheet 10*a* can be controlled finely in the side spray apparatus 40, and the hot-rolled steel sheet 10*a* can be cooled to approximately 200° C., which is a target temperature.

Here, specific conditions for such cooling in the nuclear boiling region are described. In the present embodiment, a target is to cool the hot-rolled steel sheet 10*a* to a low temperature of approximately 200° C. in the side spray apparatus 40 as described above, and to achieve this, one spray nozzle 41 jets cooling water with a large water flow density, for example, a water flow density of 4 $m^3/m^2/min$, and thereby cools the hot-rolled steel sheet 10*a*.

For example, "Forced Cooling of Steel Products", Nov. 10, 1978, The Iron and Steel Institute of Japan, discloses a correlation between surface temperature of steel products and a heat transfer coefficient for each water flow density. In addition, for example, "Cooling Techniques for Hot Steel Products", Masashi Mitsutsuka, *Tetsu-to-Hagane* Vol. 79 (1993), The Iron and Steel Institute of Japan, also discloses a correlation between surface temperature of steel products and a heat transfer coefficient for each water flow density. In the case of securing the water flow density of 4 $m^3/m^2/min$ mentioned above, according to these correlations, nuclear boiling cooling is cooling in which the upper surface temperature of the hot-rolled steel sheet 10*a* is 400° C. or less.

In addition, in the case where, for example, the width D of the steel sheet conveyance region 10 is 2000 mm and the length R of the collision region 43 in the conveyance direction is 65 mm as described above, if the near end 43*b* of the collision region 43 is the center of the steel sheet conveyance region 10, an area of the collision region 43 is 0.0325 $m^2$. Then, in order to secure a water flow density of 4 $m^3/m^2/min$ in one spray nozzle 41, an amount of water of 0.26 $m^3/min$ (=4 $m^3/m^2/min \times 0.0325\ m^2$) is needed.

<Another Embodiment of Side Spray Apparatus>

In the cooling apparatus 15 of the above embodiment, the hot-rolled steel sheet 10*a* is cooled to a low temperature of approximately 200° C., but in the case where, for example, a cooling stop temperature in the cooling apparatus 15 is not a low temperature, there is no need to jet cooling water from all the spray nozzles 41 of the side spray apparatus 40. In such a case, in consideration of cooling uniformity in the width direction, cooling performance of the side spray apparatus 40 is adjusted by performing control for each spray nozzle pair 42 having the same meeting P, so that cooling water is jetted only from spray nozzle pairs 42 needed for cooling and cooling water is not jetted from spray nozzle pairs 42 not needed for cooling. Therefore, the side spray apparatus 40 is preferably provided with a valve for controlling supply/non-supply of cooling water for each plurality of spray nozzle pairs 42.

In the case where the side spray apparatus 40 is provided with a valve for controlling supply/non-supply of cooling water, a region provided with the valve can be the cooling small zone f described above. Also in this case, the conditions of the above embodiment are preferably satisfied for each cooling small zone f. That is, in the cooling small zone f provided with the valve, the meeting P of the collision regions 43 and 43 in the spray nozzle pair 42 is formed as illustrated in FIG. 4, the meeting P is placed within the meeting zone E having a width satisfying Formula (1) above, and the interval Q in the width direction between the meetings P and P of the spray nozzle pairs 42 and 42 adjacent to each other in the conveyance direction is the length R of the collision region 43 in the conveyance direction or more. In addition, in the cooling small zone f, the meetings P are arranged in a staggered pattern as illustrated in FIGS. 9 and 10.

<Another Embodiment of Cooling Apparatus>

Figure 11:
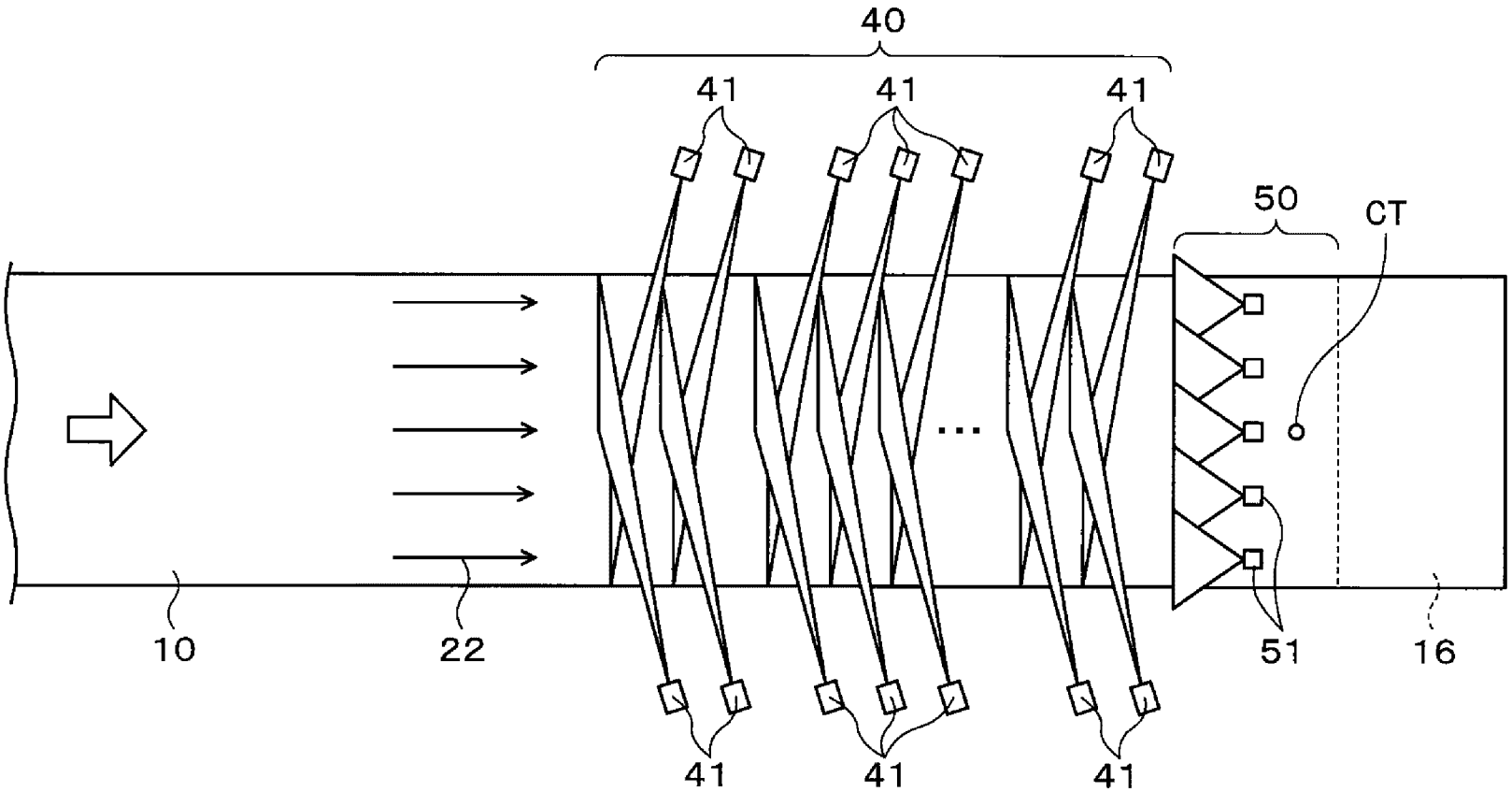
FIG. 11 is a plan view illustrating an overview of the configuration of a cooling apparatus according to another embodiment.

In the cooling apparatus 15 of the above embodiment, the dedicated water removing apparatus 30 is used for removing the on-sheet water 22 after cooling in the upper cooling apparatus 20, but such a dedicated water removing apparatus 30 may be decommissioned, and spray nozzle pairs 42 of the side spray apparatus 40 may be installed, as illustrated in FIG. 11. That is, in addition to the original spray nozzle pairs 42 used for cooling the hot-rolled steel sheet 10*a*, spray nozzle pairs 42 may be installed for water removal on the upstream side in the conveyance direction.

In such an example illustrated in FIG. 11, a facility is configured in which a plurality of spray nozzle pairs 42 are installed on both sides on the downstream side with respect to the upper cooling apparatus 20; controlling switching between the spray nozzle pairs 42 used for water removal and the spray nozzle pairs 42 used for cooling, or controlling the number of jets as necessary, in accordance with the width and thickness, conveyance speed, and steel type of the hot-rolled steel sheet 10*a* to be cooled, eliminates the need for installing the dedicated water removing apparatus 30, and enables a versatile facility to be achieved. In addition, as another example in which the spray nozzle pairs 42 are used for water removal in this manner, the dedicated water removing apparatus 50 may be decommissioned, and spray nozzle pairs 42 of the side spray apparatus 40 may be installed.

The preferred embodiment(s) of the present invention has/have been described above with reference to the accompanying drawings, whilst the present invention is not limited to the above examples. A person skilled in the art may find various alterations and modifications within the scope of the appended claims, and it should be understood that they will naturally come under the technical scope of the present invention.

Example 1

First, an effect of forming the meeting P in the present invention will be described using Example and Comparative Examples. In this verification, simulation was performed using the side spray apparatus 40 illustrated in FIGS. 2 to 6.

The common conditions of Example and Comparative Examples in the verification are as follows. The thickness of the hot-rolled steel sheet 10*a* to be cooled is 2.5 mm, and the width of the hot-rolled steel sheet 10*a* is 1500 mm. The width D of the steel sheet conveyance region 10 is 2000 mm. The side spray apparatus 40 includes eighty-four spray nozzles 41, that is, forty-two spray nozzle pairs 42. The installation height h of each spray nozzle 41 is 600 mm. A flat spray nozzle is used as each spray nozzle 41, and its spray jet angle $\theta_1$ and spray installation angle $\theta_2$ are 12 degrees and 62 degrees, respectively. The jet pressure of cooling water jetted from each spray nozzle 41 is 0.5 MPa, the water flow density of cooling water is 4.2 $m^3/m^2/min$, the amount of cooling water is 360 L/min, and the length R of the collision region 43 in the conveyance direction is 69 mm.

Figure 12:
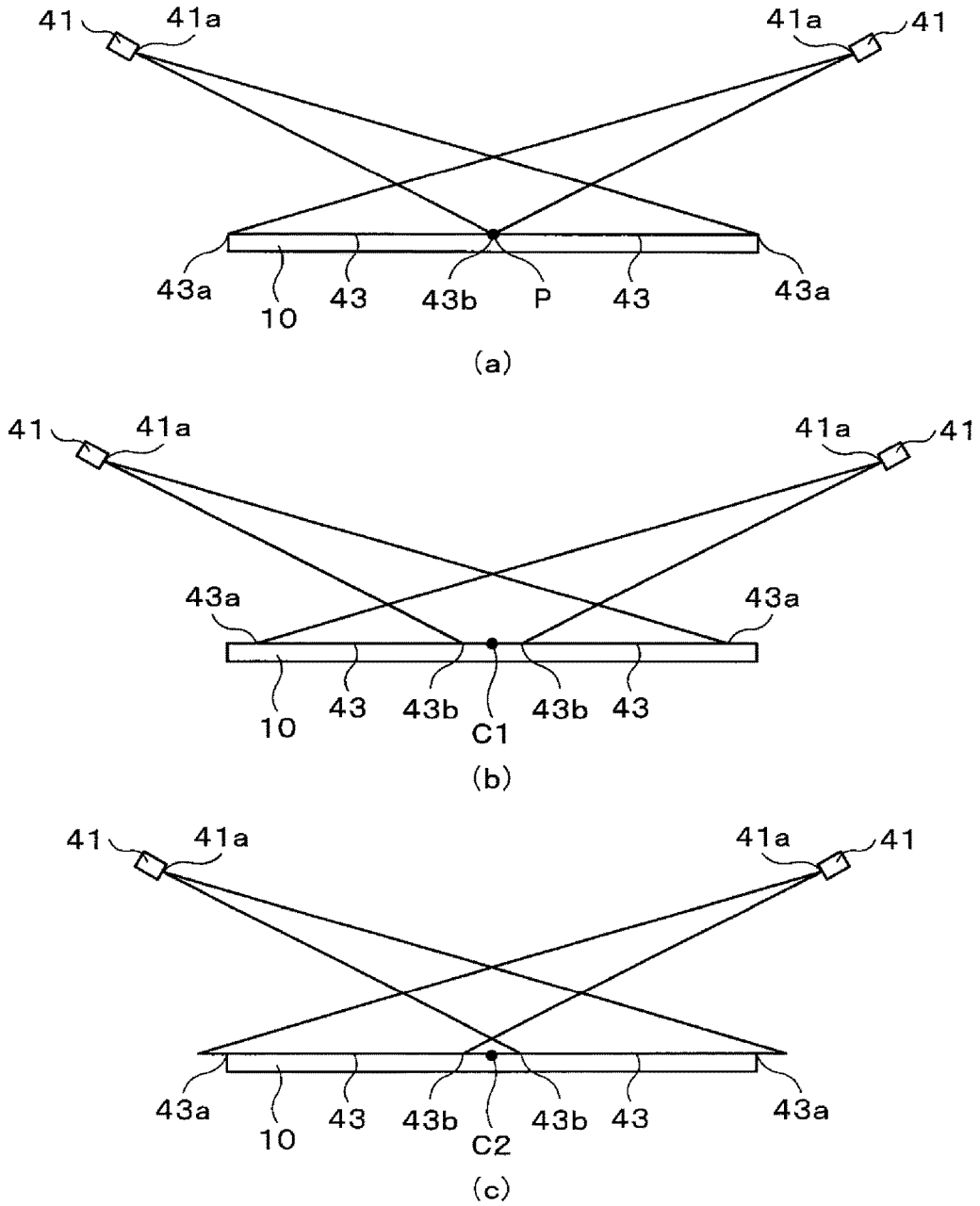
FIG. 12 is an explanatory diagram for Examples; (a) illustrates a case where a meeting is formed in collision regions from a spray nozzle pair (Example 1), (b) illustrates a case where collision regions from a spray nozzle pair overlap (Comparative Example 1), and (c) illustrates a case where collision regions from a spray nozzle pair do not overlap (Comparative Example 2).

In this verification, in Example 1 of the present invention as illustrated in FIG. 12(*a*), the meeting P is formed in the collision regions 43 and 43 of the spray nozzle pair 42. In contrast, in Comparative Example 1 as illustrated in FIG. 12(*b*), the collision regions 43 and 43 of the spray nozzle pair 42 overlap, and an interval between the near ends 43*b* and 43*b* in the overlap portion is 30 mm. In Comparative Example 2 as illustrated in FIG. 12(*c*), the collision regions 43 and 43 of the spray nozzle pair 42 do not overlap, and an interval between the near ends 43*b* and 43*b* is 30 mm.

In Example 1, in the meeting zone E satisfying Formula (1) above, the meetings P formed in 42 spots in the conveyance direction are arranged dispersed in the width direction, and further, the interval Q in the width direction between the meetings P and P adjacent to each other in the conveyance direction is set to the length R of the collision region 43 in the conveyance direction or more. Specifically, in the spray nozzle pair 42, a total horizontal distance d (=d1+d2) of a horizontal distance d1 between the jet 41*a* of one spray nozzle 41 and an end of the steel sheet conveyance region 10 and a horizontal distance d2 between the jet 41*a* of the other spray nozzle 41 and an end of the steel sheet conveyance region 10 is varied among 0 to 500 mm, and the meeting P is placed as described above.

In Comparative Example 1, the overlap portion of the collision regions 43 and 43 of the spray nozzle pair 42 is formed to be dispersed in the width direction in a manner that its center point C1 in the width direction is at the same position corresponding to the meeting P in Example 1. Similarly, also in Comparative Example 2, the non-overlap portion of the collision regions 43 and 43 of the spray nozzle pair 42 is formed to be dispersed in the width direction in a manner that its center point C2 in the width direction is at the same position corresponding to the meeting P in Example 1.

Under the conditions mentioned above, simulation was performed with a cooling start temperature of the hot-rolled steel sheet 10*a* in the side spray apparatus 40 set to 600° C., and a target temperature after cooling of the hot-rolled steel sheet 10*a* (winding temperature of the hot-rolled steel sheet 10*a* in the winding apparatus 16) set to 300° C. Then, in Example 1, Comparative Example 1, and Comparative Example 2, a winding temperature of the hot-rolled steel sheet 10*a* in the winding apparatus 16 was measured, and its deviation in the width direction (a difference between a maximum temperature and a minimum temperature in the width direction of the hot-rolled steel sheet 10*a*) was measured.

As a result, in Example 1, the temperature of the hot-rolled steel sheet 10*a* in the width direction was 300° C.±5° C., its temperature deviation being 10° C. In contrast, in Comparative Example 1, the temperature of the hot-rolled steel sheet 10*a* in the width direction was 300° C.±30° C., its temperature deviation being 60° C. In Comparative Example 2, the temperature of the hot-rolled steel sheet 10*a* in the width direction was 300° C.±25° C., its temperature deviation being 50° C.

Thus, it was found that in the case where the meeting P is formed in the spray nozzle pair 42 as in Example 1 of the present invention, temperature deviation in the width direction of the hot-rolled steel sheet 10*a* after cooling can be made small and the hot-rolled steel sheet 10*a* can be cooled uniformly in the width direction, as compared with a case where the meeting P is not formed as in Comparative Examples 1 and 2.

Example 2

Next, description will be given on the following, using Examples and Comparative Example: in the present invention, the width W of the meeting zone E where the meeting P is positioned satisfies Formula (1) above, that is, satisfies Lf/Ln≤2 (FIG. 7) described above. Also in this verification, simulation was performed using the side spray apparatus 40 illustrated in FIGS. 2 to 6.

The common conditions of Examples and Comparative Example in the verification are as follows. The thickness of the hot-rolled steel sheet 10*a* to be cooled is 2.5 mm, and the width of the hot-rolled steel sheet 10*a* is 1500 mm. The width D of the steel sheet conveyance region 10 is 2000 mm. The side spray apparatus 40 includes eighty-four spray nozzles 41, that is, forty-two spray nozzle pairs 42. The installation height h of each spray nozzle 41 is 600 mm. A flat spray nozzle is used as each spray nozzle 41.

In each of Example 2, Example 3, and Comparative Example 3 of this verification, the meeting P is formed in the collision regions 43 and 43 of the spray nozzle pair 42. The spray jet angle $\theta_1$ and the spray installation angle $\theta_2$ of each spray nozzle 41 were changed, and Lf/Ln was varied. Specifically, Lf/Ln of Example 2 of the present invention was set to 1.9, Lf/Ln of Example 3 of the present invention was set to 2.0, and Lf/Ln of Comparative Example 3 was set to 2.5.

In Example 2, the spray jet angle $\theta_1$ and the spray installation angle $\theta_2$ of each spray nozzle 41 were set to 14 degrees and 61 degrees, respectively, and Lf/Ln was set to 1.9. Moreover, in Example 2, the jet pressure of cooling water jetted from each spray nozzle 41 is 0.5 MPa, the water flow density of cooling water is 4.2 $m^3/m^2$/min, the amount of cooling water is 308 L/min, and the length R of the collision region 43 in the conveyance direction is 62 mm.

In Example 3, the spray jet angle $\theta_1$ and the spray installation angle $\theta_2$ of each spray nozzle 41 were set to 16 degrees and 59 degrees, respectively, and Lf/Ln was set to 2.0. Moreover, in Example 2, the jet pressure of cooling water jetted from each spray nozzle 41 is 0.5 MPa, the water flow density of cooling water is 4.2 $m^3/m^2$/min, the amount of cooling water is 320 L/min, and the length R of the collision region 43 in the conveyance direction is 61 mm.

In contrast, in Comparative Example 3, the spray jet angle $\theta_1$ and the spray installation angle $\theta_2$ of each spray nozzle 41 were set to 25 degrees and 50 degrees, respectively, and Lf/Ln was set to 2.5. Moreover, in Comparative Example 3, the jet pressure of cooling water jetted from each spray nozzle 41 is 0.5 MPa, the water flow density of cooling water is 4.2 $m^3/m^2$/min, the amount of cooling water is 367 L/min, and the length R of the collision region 43 in the conveyance direction is 58 mm.

In addition, in each of Example 2, Example 3, and Comparative Example 3, in the meeting zone E, the meetings P formed in 42 spots in the conveyance direction are arranged dispersed in the width direction, and the interval Q in the width direction between the meetings P and P adjacent to each other in the conveyance direction is set to 70 mm, which is the length R of the collision region 43 in the conveyance direction or more. Note that specifically, in the spray nozzle pair 42, the total horizontal distance d (=d1+d2) of the horizontal distance d1 between the jet 41*a* of one spray nozzle 41 and an end of the steel sheet conveyance region 10 and the horizontal distance d2 between the jet 41*a* of the other spray nozzle 41 and an end of the steel sheet conveyance region 10 is varied among 0 to 500 mm, and the meeting P is placed as described above.

Under the conditions mentioned above, simulation was performed with a cooling start temperature of the hot-rolled steel sheet 10*a* in the side spray apparatus 40 set to 600° C., and a target temperature after cooling of the hot-rolled steel sheet 10*a* (winding temperature of the hot-rolled steel sheet 10*a* in the winding apparatus 16) set to 300° C. Then, in Example 2, Example 3, and Comparative Example 3, a winding temperature of the hot-rolled steel sheet 10*a* in the winding apparatus 16 was measured, and its deviation in the width direction (a difference between a maximum temperature and a minimum temperature in the width direction of the hot-rolled steel sheet 10*a*) was measured.

As a result, in each of Example 2 and Example 3, the temperature of the hot-rolled steel sheet 10*a* in the width direction was 300° C.±5° C., its temperature deviation being 10° C. In contrast, in Comparative Example 3, the temperature of the hot-rolled steel sheet 10*a* in the width direction was 300° C.±25° C., its temperature deviation being 50° C.

Thus, it was found that in the case of Examples 2 and 3 of the present invention (Lf/Ln≤2), temperature deviation in the width direction of the hot-rolled steel sheet 10*a* after cooling can be made small and the hot-rolled steel sheet 10*a* can be cooled uniformly in the width direction, as compared with the case of Comparative Example 3 (Lf/Ln>2). In other words, it was found that Formula (1) above related to the width W of the meeting zone E is derived from Lf/Ln≤2, and when the meeting P is dispersed within this meeting zone E, the hot-rolled steel sheet 10*a* can be cooled uniformly in the width direction.

Example 3

Next, description will be given on the following, using Example and Comparative Example: the interval Q in the width direction between the meetings P and P of the spray nozzle pairs 42 adjacent to each other in the conveyance direction being the length R of the collision region 43 in the conveyance direction or more in the present invention, that is, the range of the influence that a temperature difference between the meeting P and surroundings exerts on the surroundings (FIG. 8). Also in this verification, simulation was performed using the side spray apparatus 40 illustrated in FIGS. 2 to 6.

The common conditions of Example and Comparative Examples in the verification are as follows. The thickness of the hot-rolled steel sheet 10*a* to be cooled is 2.5 mm, and the width of the hot-rolled steel sheet 10*a* is 1500 mm. The width D of the steel sheet conveyance region 10 is 2000 mm. The side spray apparatus 40 includes eighty-four spray nozzles 41, that is, forty-two spray nozzle pairs 42. The installation height h of each spray nozzle 41 is 600 mm. A flat spray nozzle is used as each spray nozzle 41, and its spray jet angle $\theta_1$ and spray installation angle $\theta_2$ are 12 degrees and 62 degrees, respectively. The jet pressure of cooling water jetted from each spray nozzle 41 is 0.5 MPa, the water flow density of cooling water is 4.2 $m^3/m^2$/min, the amount of cooling water is 360 L/min, and the length R of the collision region 43 in the conveyance direction is 69 mm.

In each of Example 4 and Comparative Example 4 of this verification, the meeting P is formed in the collision regions 43 and 43 of the spray nozzle pair 42. The interval Q in the width direction between the meetings P and P adjacent to each other in the conveyance direction was varied. Specifically, in Example 4 of the present invention, the interval Q in the width direction between the meetings P and P was set to 70 mm, which is greater than the length R of the collision region 43 in the conveyance direction. That is, in Example 4, n in FIG. 8 is larger than 1. In contrast, in Comparative Example 4, the interval Q in the width direction between the meetings P and P was set to 65 mm, which is shorter than the length R of the collision region 43 in the conveyance direction. That is, in Comparative Example 4, n in FIG. 8 is smaller than 1.

In addition, in each of Example 4 and Comparative Example 4, in the meeting zone E, the meetings P formed in 42 spots in the conveyance direction are arranged dispersed in the width direction. Note that in Example 4 and Comparative Example 4, in the spray nozzle pair 42, the total horizontal distance d (=d1+d2) of the horizontal distance d1 between the jet 41*a* of one spray nozzle 41 and an end of the steel sheet conveyance region 10 and the horizontal distance d2 between the jet 41*a* of the other spray nozzle 41 and an end of the steel sheet conveyance region 10 is varied among 0 to 500 mm, and the meeting P is placed as described above.

Under the conditions mentioned above, simulation was performed with a cooling start temperature of the hot-rolled steel sheet 10*a* in the side spray apparatus 40 set to 600° C., and a target temperature after cooling of the hot-rolled steel sheet 10*a* (winding temperature of the hot-rolled steel sheet 10*a* in the winding apparatus 16) set to 300° C. Then, in Example 4 and Comparative Example 4, a winding temperature of the hot-rolled steel sheet 10*a* in the winding apparatus 16 was measured, and its deviation in the width direction (a difference between a maximum temperature and a minimum temperature in the width direction of the hot-rolled steel sheet 10*a*) was measured.

As a result, in Example 4, the temperature of the hot-rolled steel sheet 10*a* in the width direction was 300° C.±5° C., its temperature deviation being 10° C. In contrast, in Comparative Example 4, the temperature of the hot-rolled steel sheet 10*a* in the width direction was 300° C.±20° C., its temperature deviation being 40° C.

Thus, it was found that in the case of Example 4 of the present invention (the case where the interval Q in the width direction between the meetings P and P is greater than the length R of the collision region 43 in the conveyance direction), temperature deviation in the width direction of the hot-rolled steel sheet 10*a* after cooling can be made small and the hot-rolled steel sheet 10*a* can be cooled uniformly in the width direction, as compared with the case of Comparative Example 3 (the case where the interval Q is smaller than the length R).

INDUSTRIAL APPLICABILITY

The present invention is useful in cooling a hot-rolled steel sheet after finish rolling of a continuous hot rolling process.

REFERENCE SIGNS LIST

1 continuous hot rolling facility
5 slab
10 steel sheet conveyance region
10*a* hot-rolled steel sheet
11 heating furnace
12 width-direction rolling mill
13 rough rolling mill
14 finish rolling mill
15 cooling apparatus
16 winding apparatus
17 conveyor roll
20 upper cooling apparatus
21 cooling water nozzle
22 on-sheet water
30, 50 water removing apparatus
31, 51 spray apparatus
40 side spray apparatus
41 spray nozzle
41*a* jet
42 spray nozzle pair
43 collision region p 43*a* far end
43*b* near end
E meeting zone
e1 to e8 meeting small zone
F cooling zone
f1 to f3 cooling small zone
f11 to f32 divided cooling small zone
P meeting

The invention claimed is:

1. A method for cooling a hot-rolled steel sheet after finish rolling of a continuous hot rolling process, the cooling method comprising:

cooling the hot-rolled steel sheet by jetting cooling water from a plurality of spray nozzles to a steel sheet conveyance region in a width direction of the steel sheet conveyance region, wherein the steel sheet conveyance region is a region that the hot-rolled steel sheet occupies on conveyor rolls, the plurality of spray nozzles configured in a plurality of spray nozzle pairs, two of the plurality of spray nozzles forming one of the plurality of spray nozzle pairs, each of the two of the plurality of spray nozzles forming the one of the plurality of spray nozzle pairs is arranged on a respective lateral side in the width direction of the steel sheet conveyance region, and the plurality of spray nozzle pairs are aligned in a conveyance direction of the hot-rolled steel sheet, wherein in regard to a collision region of cooling water jetted from the spray nozzle at the steel sheet conveyance region, a far end in a jet direction is positioned at an end of the steel sheet conveyance region, and a near end is positioned on an inner side of the steel sheet conveyance region, and the near end of the collision region on one width side of the steel sheet conveyance region and the near end of the collision region on the other width side coincide without overlap at a meeting in a front view in a conveyance direction.

2. The cooling method for the hot-rolled steel sheet, according to claim 1, wherein the meeting is positioned within a meeting zone marked off at the center in the width direction of the steel sheet conveyance region, a width of the meeting zone satisfies Formula (1) below, and an interval in the width direction between the meetings of the spray nozzle pairs adjacent to each other in the conveyance direction is a length of the collision region in the conveyance direction or more, $$W \leq (D+2d)-(D+d)\sin\theta_2/\sin(\theta_1+\theta_2) \quad (1),$$

where W is the width of the meeting zone, D is a width of the steel sheet conveyance region, d is a horizontal distance between a jet of the spray nozzle and an end of the steel sheet conveyance region on a side near to the jet, $\theta_1$ is a spray jet angle, and $\theta_2$ is a spray installation angle corresponding to an angle formed by a line from the jet of the spray nozzle perpendicular to the steel sheet conveyance region and a line connecting the jet of the spray nozzle and the near end of collision region.

3. The cooling method for the hot-rolled steel sheet, according to claim 2, wherein a cooling zone in which cooling water is jetted from the plurality of spray nozzle pairs toward the steel sheet conveyance region is divided into a plurality of cooling small zones in the conveyance direction, N spray nozzle pairs (N is an integer where N>1) are arranged in one of the plurality of cooling small zones, the meeting zone is divided into N meeting small zones at equal intervals in the width direction, one meeting is placed in each meeting small zone in the one of the plurality of cooling small zones, and the meetings in the one of the plurality of cooling small zones are arranged from an upstream side toward a downstream side in the conveyance direction, from the meeting small zone at one end of the meeting zone toward the meeting small zone at the other end.

4. The cooling method for the hot-rolled steel sheet, according to claim 3, wherein the cooling small zone is divided into k divided cooling small zones (k is a submultiple of N) in the conveyance direction, and in the i-th divided cooling small zone (i is an integer of 1 to k) in the conveyance direction, the meetings are arranged in the i-th to (jk+i)-th meeting small zones (j is an integer of 1 to (N/k−1), from the first meeting small zone on one end side of the meeting zone toward the N-th meeting small zone on the other end side.

5. The cooling method for the hot-rolled steel sheet, according to claim 1, wherein cooling of the hot-rolled steel sheet using cooling water from the spray nozzles is performed in a nuclear boiling region.

* * * * *